United States Patent [19]

Höhne

[11] 4,305,370

[45] Dec. 15, 1981

[54] PULSE GENERATOR COUPLED TO A ROTATING ELEMENT AND PROVIDING SPEED-RELATED OUTPUT PULSES

[75] Inventor: Gerd Höhne, Ludwigsburg, Fed. Rep. of Germany

[73] Assignee: Robert Bosch GmbH, Stuttgart, Fed. Rep. of Germany

[21] Appl. No.: 41,509

[22] Filed: May 22, 1979

Related U.S. Application Data

[63] Continuation of Ser. No. 834,001, Sep. 16, 1977, abandoned.

[30] Foreign Application Priority Data

Oct. 26, 1976 [DE] Fed. Rep. of Germany ..... 2648341

[51] Int. Cl.[3] ..... F02P 9/00

[52] U.S. Cl. ..... 123/609; 123/415; 123/610

[58] Field of Search ..... 123/609, 610, 611, 418, 123/415

[56] References Cited

U.S. PATENT DOCUMENTS

| | | | |
|---|---|---|---|
| 3,923,030 | 12/1975 | Luteran | 123/415 |
| 3,989,024 | 11/1976 | Lai et al. | 123/609 |
| 4,008,698 | 2/1977 | Gartner | 123/610 |
| 4,117,819 | 10/1978 | Jarrett et al. | 123/609 |
| 4,128,091 | 12/1978 | Balan et al. | 123/611 |
| 4,153,032 | 5/1979 | Chateau | 123/610 |
| 4,167,927 | 9/1979 | Mikami et al. | 123/609 |

*Primary Examiner*—P. S. Lall

*Attorney, Agent, or Firm*—Frishauf, Holtz, Goodman & Woodward

[57] ABSTRACT

To provide a composite output pulse in which the pulse length increases relative to the angle of rotation as the speed of a rotating element, typically a rotor coupled to an internal combustion engine increases so that the closing angle of current supply to an ignition coil increases with speed, a magnetic element or other marker on a rotor is exposed to two transducers, one of which provide a signal which is position dependent and the other one a signal which is speed dependent. The output signals from the transducers are combined. The position dependent transducer provides an output pulse of fixed pulse length, relative to angle of rotation of the rotating element, the speed dependent pulse providing output pulses of variable pulse length which overlap with the pulse of fixed pulse length. The speed dependent output is preferably sensed by a threshold or threshold trigger circuit so that when the level of the speed dependent output from the transducer exceeds a certain level a pulse is triggered which will not terminate, however, until the pulse from the position dependent transducer is also obtained. A triggered wave shaping stage, triggered by either of both inputs—position dependent or speed dependent and preferably having a variable response or threshold level, in dependence on battery supply voltage, can provide a single output of a pulse length extending over increasing angular segments of rotation of the rotor as the speed increases, thus maintaining an output pulse the time duration of which can be made to be essentially speed independent.

10 Claims, 5 Drawing Figures

PULSE GENERATOR COUPLED TO A ROTATING ELEMENT AND PROVIDING SPEED-RELATED OUTPUT PULSES

This is a continuation, of application Ser. No. 834,001, filed Sept. 16, 1977 now abandoned.

The present invention relates to an electronic pulse generator and transducer arrangement, and more particularly to a pulse generator-transducer combination providing ignition pulses to the ignition system of an internal combustion engine.

BACKGROUND AND PRIOR ART

It has previously been proposed to provide a contactless transducer and pulse generating system for internal combustion engines in which two transducer elements are coupled to a rotary magnetic component, driven from the engine (see German disclosure document DT-OS No. 2 425 595). The arrangement described has been used to change the ignition instant, that is ignition timing in dependence on speed. The pulse provided by that system is used only to trigger the ignition event. The pulse length is constant relative to the angle of rotation through which the rotary portion of the transducer passes.

Rotary pulse generating systems which are designed primarily to provide an output pulse at a predetermined instant to trigger an ignition frequently provide the pulse only with respect to a predetermined angle of rotation, or rotary position of a rotating element of the engine, for example the crankshaft thereof. If the pulse is simultaneously to be used to close the ignition circuit, to provide electrical energy to a spark coil, then, as the speed of the engine increases, lesser energy can be stored in the ignition coil. Thus, the energy available to trigger the spark becomes less and less, as speed increases, if the closing time of the trigger circuit is proportional to engine speed.

THE INVENTION

It is an object of the present invention to provide a transducer-pulse generator system in which the total pulse length is essentially independent of speed, but which, additionally, still provides a pulse which has a characteristic, for example its end, or termination instant, which is accurately representative of a predetermined angular position of the crankshaft, or a piston of the engine with respect to a reference, for example the upper dead center (UDC) of the piston. Thus, preferably the pulse length should be essentially independent, or certainly not dropped below a predetermined minimum, as the speed of the engine changes.

Briefly, a rotor, which has markings thereon, for example permanent magnet elements, is suitably coupled to two stationary transducer components, for example Hall generators, induction coils, or the like. One of the transducers provides a pulse of constant length relative to a specific angular rotation, and position of the rotor; the other, or second transducer provides a pulse, the length of which increases as the speed increases, so that the overall resulting pulse of the first and second transducers, when combined will be at least the pulse length of the first transducer, allowing for overlap.

In accordance with a feature of the invention, the transducer elements are composites which have wave shaping stages, such as Schmitt triggers connected thereto, the outputs of the triggers being connected to an OR gate which, in turn, controls the ignition system. The wave shaping circuits can be level-responsive and be combined, to be triggered conjointly by both transducers. To compensate for possible variations in supply voltage of the system, if used for example with an automotive storage battery, the level reference at which the triggers respond can be variable, and controlled in dependence on supply voltage.

Drawings, illustrating an example:

Figure 1:
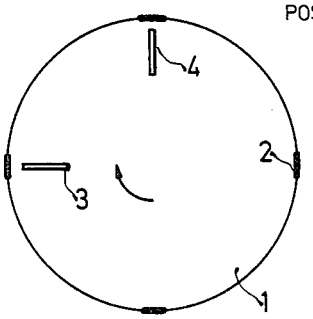
FIG. 1 is a highly schematic example of a transducer arrangement using permanent magnetic elements on the rotor.

A rotor 1 (FIG. 1) has four markers 2 located thereon, providing four pulses for each revolution of the rotor 1. The markers, for example, are permanent magnetic elements and the transducers 3, 4 are in magnetically coupled relationships to the permanent magnetic markers 2. The markers may, however, also be optical markers in which case the fixed stationary transducer component 3, 4 must be arranged to provide output signals responsive to the passage of the markers 2 past the fixed transducer parts 3, 4. The stator elements of the transducers 3, 4 are located 90° offset with respect to each other. The first transducer 3 is a position-responsive transducer and, if the system is magnetic, may, for example, be a Hall generator, a field-plate transducer, or a reed switch responsive to passage of a magnet in close proximity thereto. In essence, the output from transducer 3 will provide a signal representative of the position of a magnet 2 in front of the stator element 3, and another signal if there is no magnetic element adjacent a transducer. Thus, this signal will persist at a given level independent of speed for the duration of the presence of marker 2 in front of stator 3. The second transducer element 4 of the stator provides an output which is speed-dependent, for example it can be an induction-type transducer. At each revolution of the rotor, the transducers 3, 4 will each provide a pulse when the markings 2 pass thereby. The outputs from the transducers 3, 4 are applied to wave shaping stages 5, 6. At least one of these wave shaping stages should have a threshold level which is variable, as indicated schematically by threshold input 14'. The threshold input 14', which can set the threshold level of wave shaping stage 6 at which it responds is coupled to detect the voltage level of the supply voltage, schematically indicated by connection to the slider or tap of a potentiometer 20 and connected across the main supply of the system. The signals derived from the wave shaping stages 5, 6 are square wave pulses and are connected to a subsequent OR gate 7. The output from OR gate 7 is available at terminal 7' to be connected to the ignition system of an internal combustion engine, for example of the automotive type.

Figure 3:
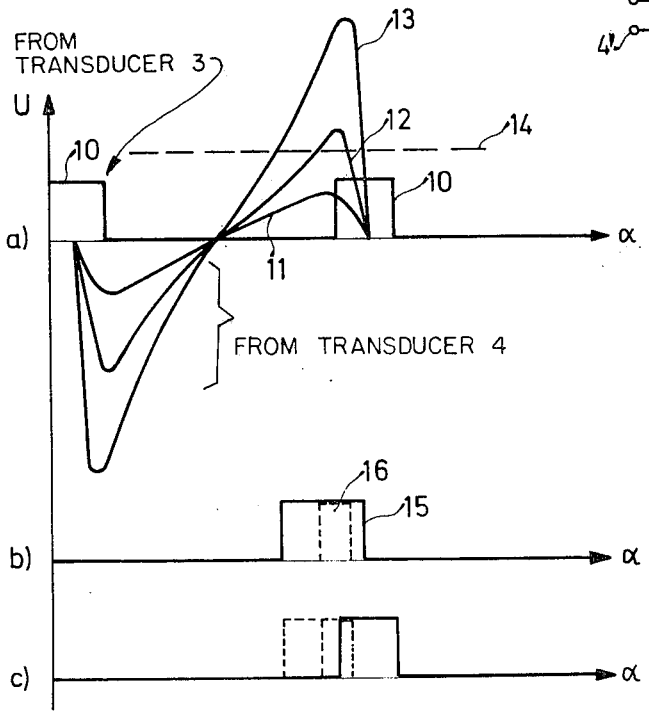
FIG. 3 is a pulse diagram of signals arising in the system of FIG. 2 with respect to angle of rotation of the rotor.

Operation, with reference to FIG. 3: graph (a) of FIG. 3 illustrates the voltage U available at the respective transducer 3, 4 as a function of the angle of rotation $\alpha$. The first transducer 3 which is the position dependent transducer will provide pulses 10 of constant level as a marker 2 passes adjacent a transducer 3. The output from transducer 3, at terminal 3' is additionally wave shaped in stage 5 to provide as close a square wave signal as possible, as illustrated in graph (a) at 10. The speed-dependent stator transducer 4 which, in the example selected, is an inductive transducer provides output signal 11, 12, 13 at the respective terminal 4', depending on the speed of passage of the rotor 1 past transducer 4. The amplitude of the output signal increases as the speed increases. Transducer 4 is so located with respect to transducer 3 that the maximum of the amplitude occurs in the period of time, or in the range during which the pulse 10, derived from transducer 3 is available. The wave shaping stage 6 has a threshold or trigger level 14, as set by the threshold at input 14'. The signals at terminal 4' are thus transformed into square wave signals having a width which depends on the intersection between the level set, or trigger level 14 and the rising amplitude of the respective curves 11, 12, 13. When the trigger is exceeded, wave shaping stage 6, for example a Schmitt trigger, will change state and provide a square wave signal, providing an output at a predetermined level, for example the maximum level of pulse 10, or of the operating level of the supply to the entire system. When the pulse at terminal 4' passes below the trigger level in a descending direction, the wave shaping stage 6 will again switch to a voltage approximately at ground, chassis or reference potential. The pulse 15, graph b of FIG. 3 shows the output signal derived from wave shaping stage 6 when the signal at terminal 4' corresponds to the curve 13. When the signal occurs at a lower speed, corresponding to the curve 12 of graph a of FIG. 3, then the pulse will be as shown by the broken line 16 in graph b of FIG. 3. The signal 11 of graph a will not generate any pulse at all from the wave shaping stage 6 since its threshold level 14 is never reached. The OR gate 7 thus additively combines the signals 15 or 16, respectively, with the signal 10. The trailing flank of the pulse or signal from OR gate 7 provides information representative of an exact and precisely determined angular position of the rotor 1 of the transducer system and thus determines the timing of an ignition event. At low speeds, the resulting pulse duration is determined essentially only by the transducer 3, since the wave shaping stage 6 of transducer 4 does not provide a pulse due to its trigger level 14. As the speed increases, pulses will be derived also from the wave shaping stage 6 so that the overall pulse duration will increase with respect to the angular coverage of the pulse 10 as related to rotation of the rotor 1, thus effectively extending the overall pulse with respect to the angular rotation and maintaining the overall pulse time substantially speed independent while providing for the precise pulse termination provided by the trailing flank of pulse 10. By suitable adjustment of the relative position of the transducer 4 with respect to the markers 2 it can readily be insured that any possible pulses derived from wave shaping stage 6 will terminate only if a pulse 10 is already available at the input to the OR gate 7.

Figure 5:
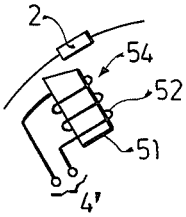
FIG. 5 is a fragmentary schematic of a fixed transducer structure located in magnetically coupled relationship to a permanent magnet element, and forming a fragmentary representation of another embodiment of the system of FIG. 1.

Both transducer 3, 4 can be located at a single specific position. The speed-dependent transducer 4 preferably should have an air gap which is angle-dependent with respect to the rotor 2. FIG. 5 illustrates a core 51 on which an inductance coil 52 is wound. Core 51 has a wedge-shaped terminal portion to form a position transducer 54, the output 4' of which can again be connected to wave shaping stage 6. Position transducer 54 thus provides a highly unsymmetrical output signal.

Figure 4:
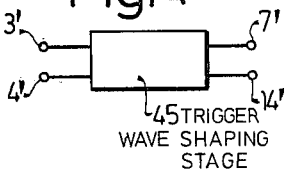
FIG. 4 is a fragmentary diagram illustrating a modification of the system.

Transducers 3 and 4 can have their respective outputs 3', 4' connected to a common pulse or wave shaping stage 45, as illustrated in FIG. 4, the output of which is directly connected to the ignition system terminal 7'. The trigger level of the wave shaping stage 45 again is variable, having a trigger level input control terminal 14' which, as in the embodiment of FIG. 2, can be connected to change the threshold level of stage 45 in dependence on change in supply voltage. The stage 45, FIG. 4, is a two input trigger input, having one input which is level-dependent and, for example an additional input which responds to an output pulse of any level. The additional input is then connected to the position transducer 3', the output from stage 45 being available as a pulse so long as at least one of the inputs has a signal present thereat. The stage 45 by suitable input circuit connection, therefore, can combine the function of the pulse or wave shaping stages 5, 6 as well as of the OR gate 7. The inputs 3', 4' can, for example be connected through de-coupling diodes and respectively adjusted input voltage dividers to the trigger terminals of a triggered multi-vibrator circuit.

Figure 2:
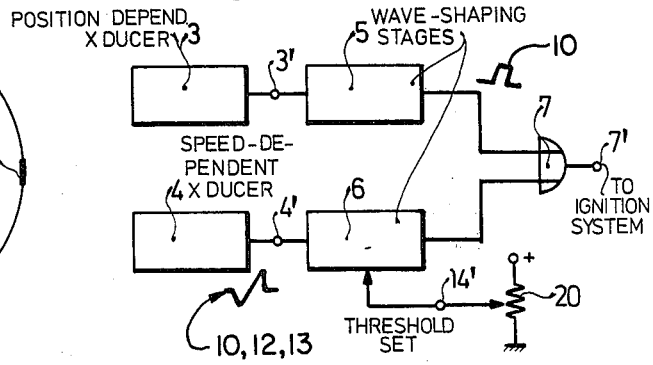
FIG. 2 is a schematic block diagram of the system.

The trigger level can be adjusted in various ways, for example as shown by connecting a variable trigger input or level control terminal, available in many wave shaping circuits as shown in FIG. 2. In another form, the trigger level can also be adjusted by providing a counter-acting magnetic field which acts on the transducer 4 to weaken the magnetic flux derived from the elements 2 as they pass past the respective speed dependent element 4 if the supply voltage exceeds a predetermined value. Such a counter-vailing flux can be obtained by connecting a bucking coil to a transducer winding, for example through a voltage sensitive device such as a Zener diode, or by a separate coil magnetically suitably arranged to be effective only if the system's voltage exceeds a certain level.

The system is readily constructed, and provides output pulses which increase in length with respect to the angle of rotation, as the speed increases, which is desirable when controlling the closing angle of an ignition system of an internal combustion engine. The overall system, and the electronic components are simple and require only few circuit elements.

In a preferred form, the two transducers are angularly offset with respect to each other by an angle of 360°/N, in which N is the number of pulses for each revolution of the rotor to be obtained from any one of the transducers. Preferably, the first transducer which provides a pulse of constant length is a position-dependent transducer, typically a Hall generator; the second transducer preferably is an induction-type transducer providing outputs which depend on speed. Changing the trigger or threshold levels of the trigger circuit 6, 45 in accordance with system supply voltage is a preferred form. It is also desirable to so arrange the air gap as illustrated in connection with FIG. 5, that is, to make the air gap between the inductive pickup 54 and the magnetic element 2 variable with respect to angle of rotation, so that the resulting output signal is highly unsymmetrical.

Various changes and modifications may be made and features described in connection with any one of the embodiments may be used with any of the others, within the scope of the inventive concept.

I claim:

1. Pulse generator providing an output pulse having a time length or duration which is essentially independent of the speed of a rotating element (1) and having a characteristic which is representative of a predetermined instantaneous angular position of the element to provide ignition pulses for the ignition system of an internal combustion engine comprising a rotor (1) having a marker (2) circumferentially positioned thereon, coupled to the rotating element;

a first transducer means (3, 5) continuously sensing passage of the marker past the transducer means, and including means (5) continuously generating first output pulses, each having a characteristic representative of the angular position of the marker (2) on the rotor (1) as it rotates past the first transducer means, and a pulse duration which is representative of the angular coverage of the marker relative to the transducer as the marker rotates, a second transducer means (4, 6) continuously generating second output pulses upon passage of the marker past the second transducer means, the second output pulses having a pulse duration which is continuously increasingly representative of angular rotation of the rotor upon increasing speed thereof, said first transducer means and second transducer means being relatively positioned with respect to the rotor to provide their respective output pulses in overlapping relationships;

and additive combining means (7, 45) connected to and controlled by said first output pulses and said second output pulses for continuously additively combining said first and second output pulses and for providing combined generator output pulses in form of a combination of said first and second pulses, said combined output pulses having the characteristic representative of the predetermined angular position of the rotor of the first pulse, and a duration which is a composite of said duration of the first pulse and the duration of the second pulse, and at least the duration of said first pulse.

2. Pulse generator according to claim 1, wherein the first transducer means comprises a fixed transducer element (3) and the pulse generating means comprises a wave shaping stage (5) connected thereto; and the second transducer means (4, 6) comprises a second fixed, speed dependent transducer element (4) and a second wave shaping stage (6) connected thereto.

3. Pulse generator according to claim 2, wherein the combining means comprises combining circuit means (7) connected to the outputs of said wave shaping stages (5, 6).

4. Pulse generator according to claim 1, wherein said first transducer means comprises a position dependent transducer (3) providing said first output pulse as a function of instantaneous angular position of a marker with respect to the transducer means;

said second transducer means comprises a speed dependent transducer (4);

and a common trigger wave shaping stage (45) having two inputs connected to said respective transducers and forming part of said combining means and of said pulse generating means.

5. Pulse generator according to claim 1, wherein the first and second transducers are offset angularly with respect to each other by an angle of 360°/N wherein N is the number of the pulses per revolution of the rotor to be provided by the first and second transducer means (3, 4).

6. Pulses generator according to claim 1, wherein the first transducer means comprises a position-dependent transducer (3) providing said first output pulse as a function of instantaneous angular position of a marker with respect to said first transducer means;

and the second transducer means includes a fixed speed-dependent transducer element (4) providing said second pulse having a level varying with speed.

7. Pulse generator according to claim 1, wherein the first transducer means includes a Hall generator.

8. Pulse generator according to claim 1, wherein the second transducer means includes an inductive transducer.

9. Pulse generator according to claim 1, wherein said second element means includes an inductive transducer, the marking on said rotor including magnetic elements (2), and the inductive element having a core (51) forming a variable air gap with the magnetic elements (2) as the magnetic elements of the rotor pass past the inductive transducer.

10. Pulse generator according to claim 1, wherein at least one of the transducer means includes a threshold, or level responsive trigger stage (6, 45), the trigger level, or threshold response of which is adjustable; and means (20) changing the response level of said trigger stage as a function of supply voltage of the electrical supply to the pulse generator.

* * * * *